United States Patent [19]

O'Reilly

[11] Patent Number: 5,020,280

[45] Date of Patent: Jun. 4, 1991

[54] GRINDING TOOL AND SPACER ASSEMBLY FOR USE THEREIN

[76] Inventor: Gerard O'Reilly, Box 309, Yisod Hama'ala, Israel

[21] Appl. No.: 560,830

[22] Filed: Jul. 31, 1990

[30] Foreign Application Priority Data

Aug. 11, 1989 [IL] Israel ..... 91283

[51] Int. Cl.[5] ..... B24B 41/00

[52] U.S. Cl. ..... 51/168; 279/1 A; 279/8; 125/13.01; 30/276

[58] Field of Search ..... 51/168; 279/1 A, 8, 279/99; 30/276, 347; 125/13.01, 17, 18

[56] References Cited

U.S. PATENT DOCUMENTS

| | | | |
|---|---|---|---|
| 1,979,325 | 11/1934 | Goldberg | 279/99 |
| 2,887,830 | 5/1959 | Else | 51/74 |
| 4,009,637 | 3/1977 | Bittner | 51/168 |
| 4,033,319 | 7/1977 | Winter | 125/13.01 |
| 4,188,934 | 2/1980 | Reinhardt | 51/170 PT |

FOREIGN PATENT DOCUMENTS

| | | | |
|---|---|---|---|
| 120975 | 9/1980 | Japan | 51/168 |
| 188074 | 8/1986 | Japan | 51/168 |
| 199356 | 9/1987 | Japan | 51/168 |
| 398519 | 9/1933 | United Kingdom | 51/168 |

*Primary Examiner*—Roscoe V. Parker

*Attorney, Agent, or Firm*—Kenyon & Kenyon

[57] ABSTRACT

A grinding tool includes a rotary motor driving a rotary drive shaft, a first grinding disc having a center opening for receiving the drive shaft, with the outer end of the drive shaft projecting through the opening in the grinding disk, a spacer assembly having a socket at one end receiving the projecting end of the drive shaft, a pin at the opposite end, and a spacer between said socket and pin, a second grinding disc having a center opening for receiving the pin of the spacer assembly with the outer end of the pin projecting through the latter opening and an outer collar attached to the projecting end of the pin for securing the two grinding discs to the drive shaft in spaced-apart relationship such as to enable the grinding tool to simultaneously cut two spaced grooves.

20 Claims, 2 Drawing Sheets

GRINDING TOOL AND SPACER ASSEMBLY FOR USE THEREIN

BACKGROUND OF THE INVENTION

The present invention relates to a grinding tool, and particularly to one provided with two spaced grinding discs for simultaneously cutting two spaced grooves. The invention also relates to a spacer assembly which may be used with existing grinding tools having but a single grinding disc, to convert the grinding tool to one capable of simultaneously cutting two spaced grooves.

The invention is particularly useful with respect to grinding tools for cutting grooves in concrete walls in order to accommodate pipes or conduits passing through the walls. When the grinding tool is used for this purpose, it cuts two spaced grooves in the concrete wall, and the space between the grooves is then chiselled out in order to define a larger groove for accommodating the pipe or conduit.

One known form of grinding tool used for this purpose includes a grinding disc which cuts a single groove at one time. When using this type of tool, however, the two grooves must be cut separately, which substantially increases the time required for performing this operation.

Another type of grinding tool is also known including two grinding discs in spaced relation and adapted to simultaneously cut two spaced grooves, but such a known tool is substantially more complicated in construction, and therefore more expensive, than the single-disc grinding tool mentioned above.

An object of the present invention is to provide a grinding tool of relatively simple construction adapted to simultaneously cut two spaced grooves. Another object of the invention is to provide a spacer assembly which may be used with the existing single-disc grinding tools to convert such a tool for simultaneously cutting two spaced grooves.

According to one aspect of the present invention, there is provided a grinding tool comprising a rotary motor driving a rotary drive shaft; a first grinding disc having a center opening for receiving said drive shaft with the outer end of the drive shaft projecting through the opening in the grinding disc; a spacer assembly having a socket at one end receiving the projecting end of said drive shaft, a pin at the opposite end, and spacer means between said socket and pin; a second grinding disc having a center opening for receiving said pin of the spacer assembly with the outer end of the pin projecting through the latter opening; and an outer collar attached to said projecting end of the pin for securing the two grinding discs to the drive shaft in spaced apart relationship such as to enable the grinding tool to cut two spaced grooves.

According to another aspect of the invention, there is provided a spacer assembly for use with a grinding tool comprising: a rotary motor driving a rotary drive shaft, a first grinding disc having a center opening for receiving the drive shaft with the outer end of the drive shaft projecting through the opening in the grinding disc, and an outer collar attached to the projecting end of the pin for securing the grinding disc to the drive shaft. The spacer assembly comprises a socket at one end receiving the projecting end of the drive shaft, a pin at the opposite end, and spacer means between the socket and pin. The socket is adapted to project through the opening of the first grinding disc to thereby enable the spacer assembly to receive a second grinding disc having a center opening receiving the pin with the outer end of the pin projecting through the latter opening, whereby the outer collar may be attached to the projecting end of the pin to secure the two grinding discs to the drive shaft in spaced apart relation, and thereby to enable the grinding tool to simultaneously cut two spaced grooves.

According to preferred features in the preferred embodiment of the invention described below, the spacer assembly comprises a first spacer washer fixed at the socket end of the spacer assembly to bear against the first grinding disc; and a second spacer washer fixed at the pin end of the spacer assembly to bear against the second grinding disc.

According to a still further feature in the described preferred embodiments, the spacer assembly may further comprise one or more additional washers received over the pin between the second washer and the second grinding disc, to further space the second grinding disc from the first grinding disc.

It will thus be seen that the invention may be embodied in either a grinding tool constructed to have two grinding discs, or in a spacer assembly for converting existing single-disc grinding tools to two disc grinding tools, to enable two grooves to be simultaneously cut.

Further features and advantages of the invention will be apparent from the description below.

BRIEF DESCRIPTION OF THE DRAWINGS

The invention is herein described, by way of example, with reference to the accompanying drawings, wherein.

DETAILED DESCRIPTION

Figure 1:
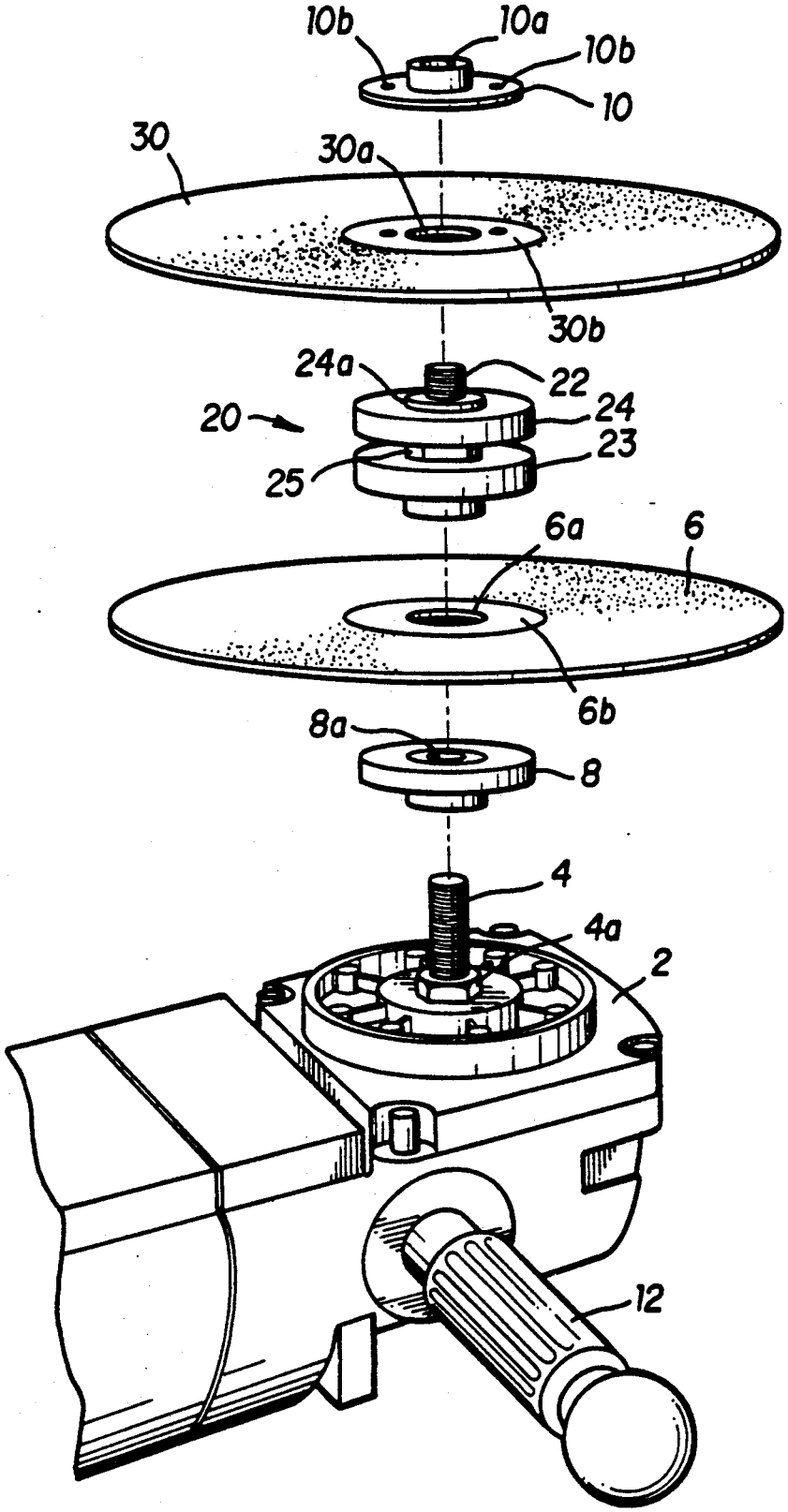
FIG. 1 is an exploded, three-dimensional view illustrating one form of grinding tool constructed in accordance with the present invention.

FIG. 1 illustrates a known grinding tool commonly used for cutting a single groove but modified to include a spacer assembly constructed in accordance with the present invention to convert the grinding tool to one for simultaneously cutting two spaced grooves. As indicated earlier, such grinding tools are commonly used for cutting grooves in concrete to support pipes or other conduits, by cutting two spaced grooves and then chiselling out the concrete between the grooves to provide an enlarged groove for accommodating the pipe or other conduits.

The grinding tool illustrated in FIG. 1 includes a rotary motor 2 within a housing and having a rotary drive shaft 4 projecting through one end of the motor housing. Drive shaft 4 is externally threaded and is adapted to receive a grinding disc 6 formed with a central opening 6*a* through which drive shaft 4 projects. The grinding disc is securely fixed to the drive shaft 4 by an inner collar 8 and an outer collar 10. Both collars are formed with central openings 8a, 10a, which are internally threaded for receiving the externally-threaded drive shaft 4 of the motor 2.

In the known single-disc grinding tool, the outer collar 10 is further formed with a pair of recesses 10b for receiving a tool to tighten the outer collar 10 onto drive shaft 4. The drive shaft 4 is further provided with a head 4a of polygonal (e..g, hexagonal) configuration for receiving a wrench in order to apply the counter-force when the outer collar 10 is threaded onto the drive shaft 4 to clamp the grinding disc 6 between it and the inner collar 8.

The grinding tool illustrated in FIG. 1 further includes a side-handle 12 to facilitate holding the tool when used for cutting grooves. Grinding disc usually a carborundum disc including a metal insert 6b engaged by the two collars 8, 10 for firmly fixing the disc to the drive shaft 4.

The construction insofar as described is well-known in single-disc grinding tools of the foregoing type, and therefore further details of its construction or manner of use are not set forth herein.

In accordance with the present invention, the single-disc grinding tool illustrated in FIG. 1 includes a spacer assembly, generally designated 20, to enable a second grinding disc 30 to be secured to the drive shaft 4 in spaced relationship with respect to the first grinding disc 6, and thus to enable the grinding tool to simultaneously cut two spaced grooves, instead of a single groove as in the conventional single-disc grinding tool.

Figure 2:
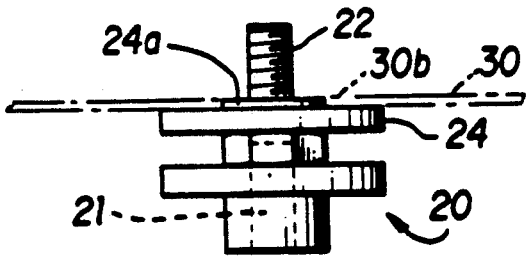
FIG. 2 is a side elevational view illustrating the spacer assembly in the grinding tool of FIG. 1.

The spacer assembly 20, as also shown in FIG. 2, is formed with a bore or socket 21 at one end for receiving the projecting end of the drive shaft 4, a pin 22 at the opposite end for receiving the outer collar 10, two spacer discs 23, 24, and a hexagonal head 25 between the two spacer discs. Spacer assembly 20 is preferably constructed as a single unit in which all the foregoing elements are integrally fixed to each other.

Socket 21 formed at one end of the spacer assembly 20 is internally threaded so as to mate with the externally-threaded drive shaft 14 projecting through the opening 6a in grinding disc 6. Pin 22 at the opposite end is externally threaded so as to mate with the internal threads of the outer collar 10 when pin 22 is passed through the central opening 30a of the second grinding disc 30. The second grinding disc 30 is also provided with a metal insert 30b which is engaged between washer 24 and the outer collar 20 when the latter is applied, to firmly secure the grinding disc to the drive shaft 4 in spaced relationship with respect to the first grinding disc 6. The outer spacer washer 24, adapted to bear against the outer grinding disc 30, is formed with a circular rib 24a adapted to project through the center opening 30a of grinding disc 30 to engage the inner edge of its metal insert 30b. Preferably, circular rib 24a is slightly thicker than the thickness of grinding disc 30 and its metal insert 30b so as to project slightly on the opposite side of the grinding disc. It is received within a circular recess (not shown) formed in the underface of the outer collar 10 circumscribing its opening 10a. Such an arrangement firmly clamps the outer grinding disc 30 between spacer washer 24 of spacer assembly 20 and the outer collar 10.

The manner of assembling the two grinding discs 6 and 30 to the drive shaft 4 will be apparent from the above description. Thus, the first grinding disc 6 is applied in the conventional manner except that the spacer assembly 20 is used, instead of the outer collar 10, for clamping it to drive shaft 4, the tightening of the spacer assembly 20 onto the drive shaft 4 being effected by a wrench received by the hexagonal head 4a of the drive shaft and 25 of the spacer assembly. After disc 6 has thus been mounted to the drive shaft, the second disc 30 is clamped between spacer assembly 20 and the outer collar 10, the threading of the outer collar onto pin 22 being 1o outer collar (10, FIG. 1) to the pin 122 of the spacer assembly, with the two grinding discs spaced apart by the spacer assembly.

Figure 3:
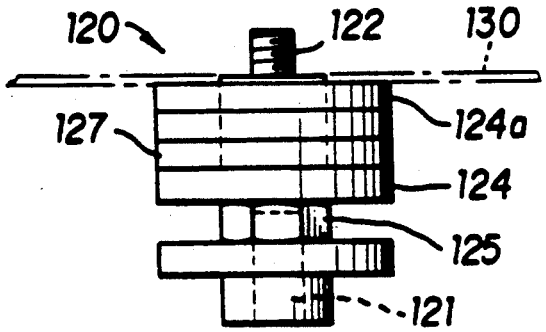
FIG. 3 is a side elevational view illustrating a modification in the spacer assembly enabling the spacing between the two grinding discs to be enlarged as desired.

FIG. 3 illustrates a spacer assembly, generally designated 120, similar to FIG. 1 but adapted to accommodate a plurality of further spacer washers, 127, in order to increase the spacing between the two grinding disc. Otherwise, the construction of the spacer assembly is basically the same as described above with respect to FIG. 1.

Figure 4:
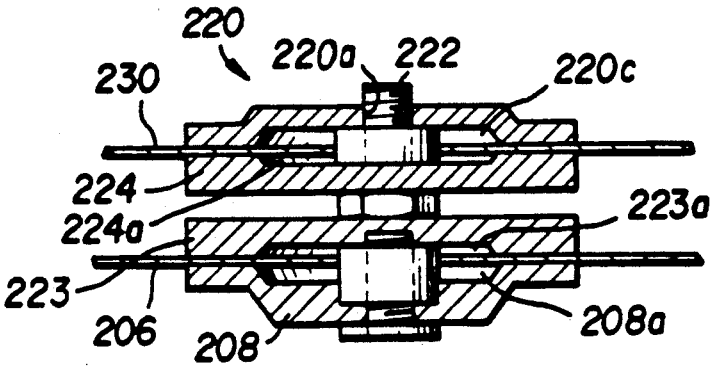
FIG. 4 is a side elevational view illustrating another form of spacer assembly that may be used in the grinding tool of FIG. 1.

FIG. 4 illustrates a spacer assembly, generally designated 220, which is similar to spacer assembly 20 in FIGS. 1 and 2, except that the outer spacer washer 224 is not formed with an annular rib (24a, FIGS. 1 and 2), but rather with an annular recess 224a circumscribing its pin 222. The outer collar 220 is also formed with an annular recess 220c (as described above with respect to FIGS. 1 and 2) circumscribing its opening 220a for receiving pin 222. Thus, the outer disc 230 is firmly clamped between the outer non-recessed surfaces of spacer washer 224 and the outer collar 220.

In FIG. 4, a similar construction is provided with respect to the inner spacer washer 223 of spacer assembly 220 and the inner collar 208 Thus, both are formed with circular recesses, as shown at 208a and 223a, respectively, for firmly clamping the inner grinding disc 206 to the motor drive shaft 4.

Figure 5:
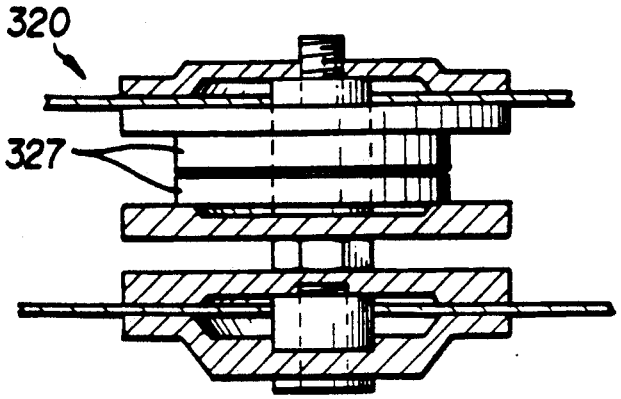
FIG. 5 is a side elevational view illustrating a modification in the construction of the spacer assembly of FIG. 4 to enable the spacing between the grinding discs to be enlarged.

FIG. 5 illustrates a spacer assembly, generally designated 320, similar to that of FIG. 4 but adapted to accommodate a plurality of further spacer washers, 327, in order to increase the spacing between the two grindings discs 206 and 330. Otherwise, the construction of the spacer assembly 320 is basically the same as described above with respect to FIG. 4.

It will thus be seen that the invention permits single-disc grinding tools to be easily converted to two-disc tools wherein two grooves are simultaneously cut. Any or all of the above-described spacer assemblies may be provided to enable the user not only to quickly convert the single-disc tool for simultaneously cutting two grooves, but also to space the grooves as may be desired for any particular application. Thus, if two spaced grooves to accommodate a one-half inch pipe are to be cut, either of the spacer assemblies illustrated in FIGS. 2 and 4 may be used; and if the grooves are to be cut are to accommodate a one-inch pipe, either of the spacer assemblies illustrated in FIGS. 3 and 5 may be used. The spacing may be further varied by increasing or decreasing the number of spacer washers (e.g., 127, 327) included in the spacer assembly.

While the invention has been described with respect to several preferred embodiments, it will be appreciated that these are set forth merely for purposes of example, and that many other variations, modifications and applications of the invention may be made.

What is claimed is:

1. A grinding tool, comprising:

a rotary motor driving a rotary drive shaft;

a first grinding disc having a center opening for receiving said drive shaft with the outer end of the drive shaft projecting through the opening in the grinding disc;

a spacer assembly having a socket at one end receiving the projecting end of said drive shaft, a pin at the opposite end, and spacer means between said socket and pin;

a second grinding disc having a center opening for receiving said pin of the spacer assembly with the outer end of the pin projecting through the latter opening;

and an outer collar attached to said projecting end of the pin for securing the two grinding discs to the drive shaft in spaced apart relationship such as to enable the grinding tool to simultaneously cut two spaced grooves.

2. The grinding tool according to claim 1, wherein said spacer assembly comprises:

a first spacer washer fixed at the socket end of the spacer assembly to bear against said first grinding disc;

and a second spacer washer fixed at the pin end of said spacer assembly to bear against said second grinding disc.

3. The grinding tool according to claim 2, wherein said spacer assembly further comprises a wrench-receiving member of polygonal configuration fixed between said first and second washers.

4. The grinding tool according to claim 3, wherein said drive shaft is externally threaded, and said socket in said spacer assembly is internally threaded for attaching the socket assembly and the first grinding disc to the drive shaft.

5. The grinding tool according to claim 4, wherein said pin on the spacer assembly is externally threaded, and said outer collar is internally threaded for attaching the second grinding disc to the drive shaft in spaced relation with respect to said first grinding disc.

6. The grinding tool according to claim 3, wherein said second spacer washer is formed with a circular rib circumscribing its opening and projecting through the opening in the second grinding desc, and said outer collar is formed with a circular recess receiving said circular rib when the outer collar is attached to the pin of the spacer assembly.

7. The grinding tool according to claim 3, wherein said second spacer washer is formed with a circular recess circumscribing its opening, and said outer collar is also formed with a circular recess circumscribing its opening, so that the second grinding disc is firmly clamped between the outer non-recessed surfaces of the second spacer washer and outer collar when the outer collar is attached to the pin of the spacer assembly.

8. The grinding tool according to claim 3, wherein said spacer assembly further comprises one or more additional washers received over said pin between said second wahser and said second grinding disc, to further space the second grinding disc from the first grinding disc.

9. A spacer assembly for use with a grinding tool comprising a rotary motor driving a rotary drive shaft, a first grinding disc having a center opening for receiving said drive shaft with the outer end of the drive shaft projecting through the opening in the grinding disc, and an outer collar attached to the projecting end of the pin for securing the grinding disc to the drive shaft comprising:

a socket at one end receiving the projecting end of said drive shaft, a pin at the opposite end, and spacer means between said socket and pin;

said pin being adapted to project through the opening of said first grinding disc to thereby enable the spacer assembly to receive a second grinding disc having a center opening receiving said pin with the outer end of the pin projecting through the latter opening, whereby said outer collar may be attached to said projecting end of the pin to secure the two grinding discs to the drive shaft in spaced apart relation, and thereby to enable the grinding tool to simultaneously cut two spaced grooves.

10. The spacer assembly according to claim 9, wherein said spacer assembly comprises:

a first spacer washer fixed at the socket end of the spacer assembly to bear against said first grinding disc;

and a second spacer washer fixed at the pin end of said spacer assembly to bear against said second grinding disc.

11. The spacer assembly according to claim 10, wherein said spacer assembly further comprises a wrench-receiving member of polygonal configuration fixed between said first and second washers.

12. The spacer assembly according to claim 11, wherein said drive shaft is externally threaded, and said socket in said spacer assembly is internally threaded for attaching the socket assembly and the first grinding disc to the drive shaft.

13. The spacer assembly according to claim 12, wherein said pin on the spacer assembly is externally threaded, and said outer collar is internally threaded for attaching the second grinding disc to the drive shaft in spaced relation with respect to said first grinding disc.

14. The spacer assembly according to claim 11, wherein said second spacer washer is formed with a circular rib circumscribing its opening and projecting through the opening in the second grinding disc, and said outer collar is formed with a circular recess receiving said circular rib when the outer collar is attached to the pin of the spacer assembly.

15. The spacer assembly according to claim 11, wherein said second spacer washer is formed with a circular recess circumscribing its opening, and said outer collar is also formed with a circular recess circumscribing its opening, so that the second grinding disc is firmly clamped between the outer non-recessed surfaces of the second spacer washer and outer collar when the outer collar is attached to the pin of the spacer assembly.

16. The spacer assembly according to claim 11, wherein said spacer assembly further comprises one or more additional washers received over said pin between said second washer and said second grinding disc, to further space the second grinding disc from the first grinding disc.

17. The grinding tool according to claim 1, wherein said drive shaft is externally threaded, and said socket in said spacer assembly is internally threaded for attaching the socket assembly and the first grinding disc to the drive shaft.

18. The grinding tool according to claim 17, wherein said pin on the spacer assembly is externally threaded, and said outer collar is internally threaded for attaching the second grinding disc to the drive shaft in spaced relation with respect to said first grinding disc.

19. The spacer assembly according to claim 9, wherein said drive shaft is externally threaded, and said socket in said spacer assembly is internally threaded for attaching the socket assembly and the first grinding disc to the drive shaft.

20. The spacer assembly according to claim 19, wherein said pin on the spacer assembly is externally threaded, and said outer collar is internally threaded for attaching the second grinding disc to the drive shaft in spaced relation with respect to said first grinding disc.

* * * * *